US008388372B2

(12) United States Patent
He et al.

(10) Patent No.: US 8,388,372 B2
(45) Date of Patent: Mar. 5, 2013

(54) ELECTRICAL CONNECTOR WITH IMPROVED HIGH FREQUENCY SIGNAL TRANSMISSION ENVIRONMENT

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 431 days.

(21) Appl. No.: 12/732,427

(22) Filed: Mar. 26, 2010

(65) Prior Publication Data

US 2010/0248552 A1 Sep. 30, 2010

(51) Int. Cl.
*H01R 13/73* (2006.01)

(52) U.S. Cl. ..... 439/541.5; 439/941; 439/101

(58) Field of Classification Search ..... 439/541.5, 439/941, 79, 101, 108
See application file for complete search history.

(56) References Cited

U.S. PATENT DOCUMENTS 6,093,060 A * 7/2000 Wiebking et al. ..... 439/541.5
7,008,261 B2 * 3/2006 Xue et al. ..... 439/541.5
7,467,977 B1 * 12/2008 Yi et al. ..... 439/541.5
7,559,805 B1 * 7/2009 Yi et al. ..... 439/660
7,789,706 B2 * 9/2010 Chen et al. ..... 439/660
7,887,370 B2 * 2/2011 Chen et al. ..... 439/607.35

OTHER PUBLICATIONS

High-Difinition Multimidia Interface 1.3 Specification, Jun. 22, 2006, pp. 37-52.
Universal Serial Bus 3.0 Specification, Nov. 12, 2008, pp. 85-95.

* cited by examiner

*Primary Examiner* — Felix O Figueroa
(74) *Attorney, Agent, or Firm* — Wei Te Chung; Ming Chieh Chang

(57) ABSTRACT

An electrical connector defining a receiving cavity for receiving a corresponding plug includes an insulative housing and a number of contacts retained in the insulative housing. The contacts include a number of first contacts which are arranged in a row along a transverse direction of the insulative housing. The first contacts include two pairs of differential signal contacts and a grounding contact between said two pairs of differential signal contacts. Each first contact has a contact portion extending into the receiving cavity, a tail portion extending out of the insulative housing and a connecting portion between the contact portion and the tail portion. The connecting portion of the grounding contact is wider than that of the differential signal contacts in the transverse direction.

19 Claims, 5 Drawing Sheets

ELECTRICAL CONNECTOR WITH IMPROVED HIGH FREQUENCY SIGNAL TRANSMISSION ENVIRONMENT

BACKGROUND OF THE INVENTION

1. Field of the Invention

The present invention relates to electrical connectors, more particularly to electrical connectors with improved high frequency signal transmission environment.

2. Description of Related Art

HDMI (High Definition Multimedia Interface) connectors and USB 3.0 connectors present as high frequency connectors to transmit high frequency signal between computers or other electrical devices. A HDMI connector or an USB 3.0 connector usually includes an insulative housing and a plurality of contacts retained therein. The contacts includes a plurality of pairs of differential signal contacts and a plurality of grounding contacts between adjacent two pairs of said differential signal contacts. Usually, the differential signal contacts and the grounding contacts have the same structure for being easily produced. Each contact has a retaining portion retained in the insulative housing, a contact portion extending forwardly to electrically connect with a corresponding plug and a tail portion behind the retaining portion to connect with circuit board. A plurality of the differential contacts and grounding contacts are arranged in a row in a transverse direction and have same distance therebetween in the transverse direction.

As we know, the electrical industry trends to miniature and have a high signal transmission, thereby the contacts in HDMI connector and USB 3.0 connector have a close arrangement with equal distance therebetween to make them occupy a small area, and the HDMI connector standardized at 2006 and USB 3.0 connector standardized at the end of 2008 each has a speed rate of up to 5 Gb/s to satisfy the high signal transmission. However, the close arrangement between adjacent two pairs of differential signal contacts in the high frequency connector easily causes high crosstalk therebetween, and the crosstalk has a bad effect to the high frequency signal transmission and make the connectors can not reach an expected high signal transmission purpose.

Hence, an improved electrical connector is desired to overcome the above problems.

BRIEF SUMMARY OF THE INVENTION

According to one aspect of the present invention, an electrical connector comprises: an insulative housing defining a first receiving cavity with a first tongue extending thereinto and a second receiving cavity with a second tongue extending thereinto, the first receiving cavity communicating with the second receiving cavity in an up to down direction and being essentially narrower than the second receiving cavity, the first tongue being parallel to the second tongue; a plurality of first contacts arranged in a row along a transverse direction of the insulative housing and being equipped with a first center grounding contact and two pairs of first differential signal contacts at two sides of said first center grounding contact, each first contact having a contact portion disposed on a mounting surface of the first tongue, a tail portion extending out of the insulative housing and a connecting portion between the contact portion and the tail portion; and a plurality of second contacts disposed on opposite first and second surfaces of the second tongue; wherein the tail portions defines a first distance between said two pairs of first differential signal contact and a second distance in each pair of first differential signal contact in a transverse direction of the insulative housing, and the first distance is twice larger than the second distances.

According to another aspect of the present invention, an electrical connector defining a receiving cavity for receiving a corresponding plug, comprises: an insulative housing; a plurality of contacts retained in the insulative housing, the contacts comprising a plurality of first contacts which are arranged in a row along a transverse direction of the insulative housing, the first contacts comprising two pairs of differential signal contacts and a grounding contact between said two pairs of differential signal contacts, each first contact having a contact portion extending into the receiving cavity, a tail portion extending out of the insulative housing and a connecting portion between the contact portion and the tail portion; wherein the connecting portion of the grounding contact is wider than that of the differential signal contacts in the transverse direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
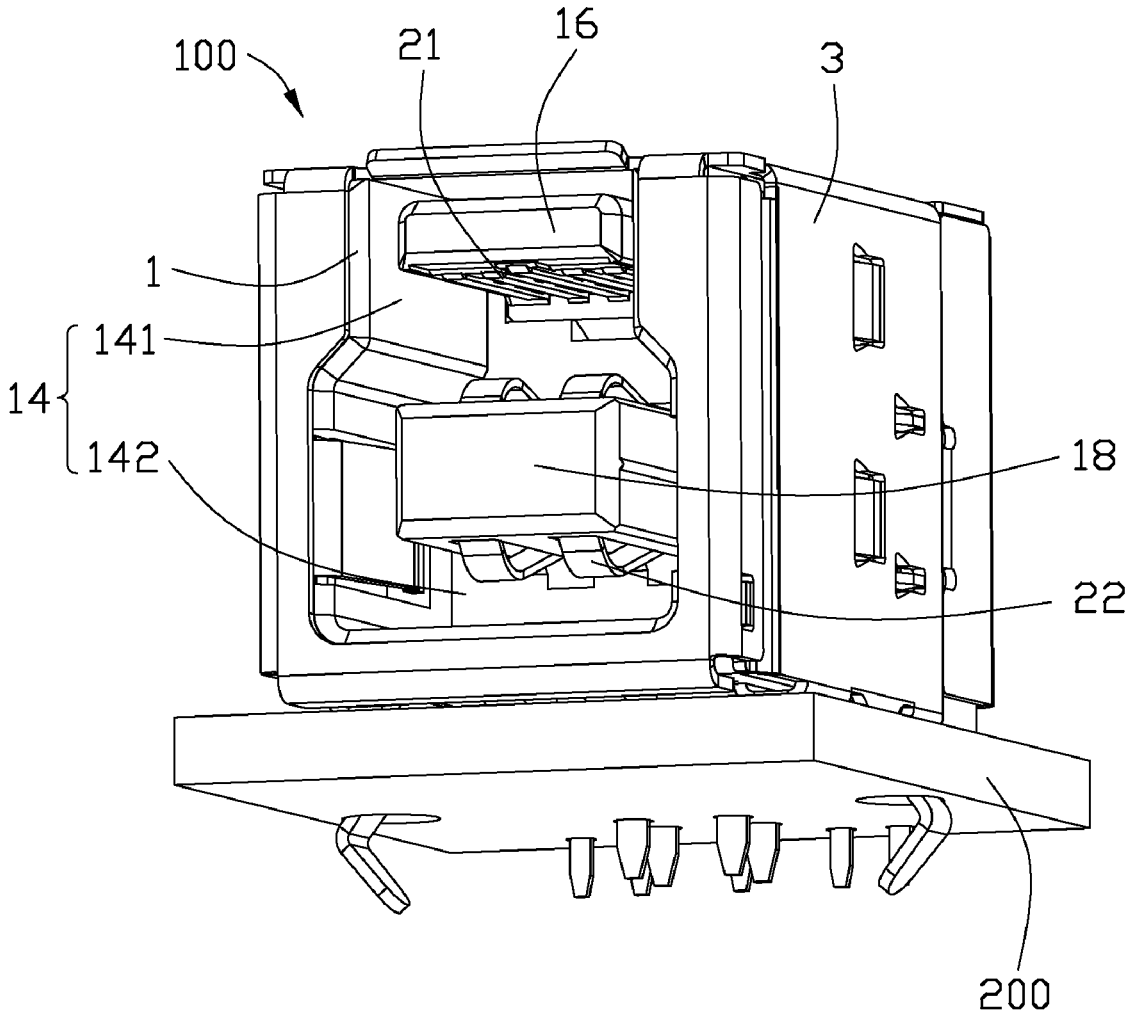
FIG. 1 is a perspective view of an electrical connector with a circuit board according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
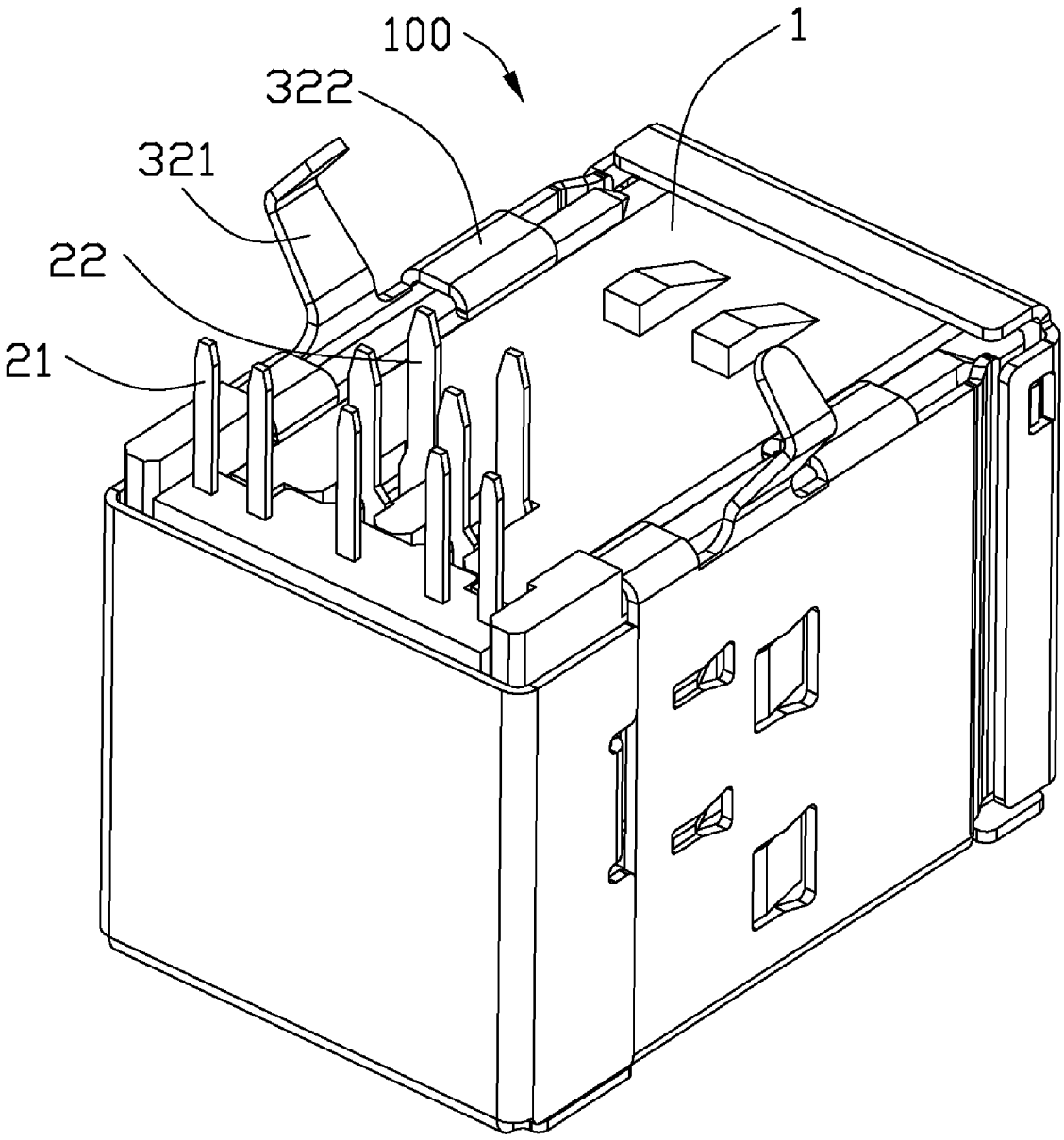
FIG. 2 is a perspective view of the electrical connector similar to FIG. 1, while taken from a different aspect.
Figure 3:
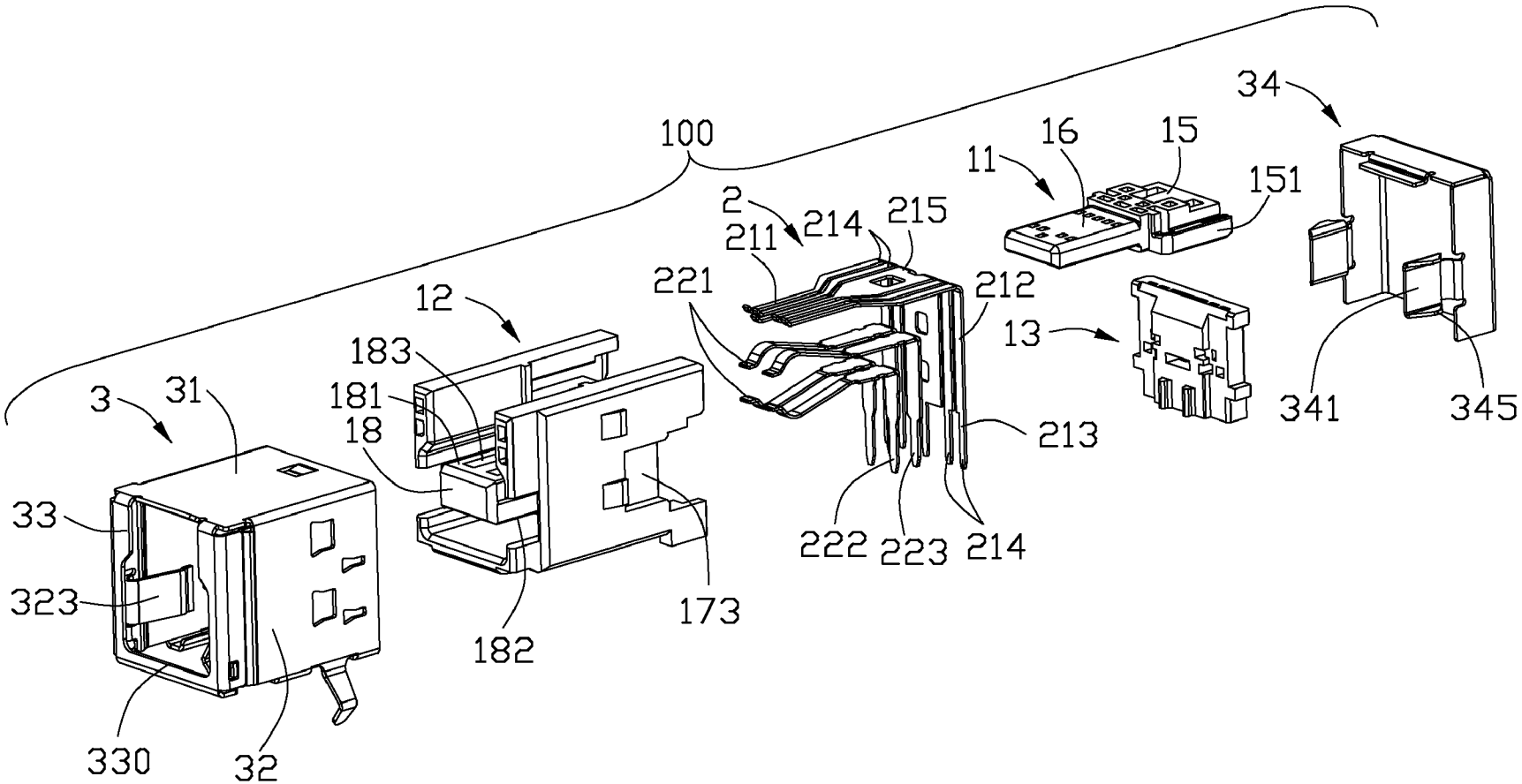
FIG. 3 is an exploded view of the electrical connector shown in FIG. 1.
Figure 4:
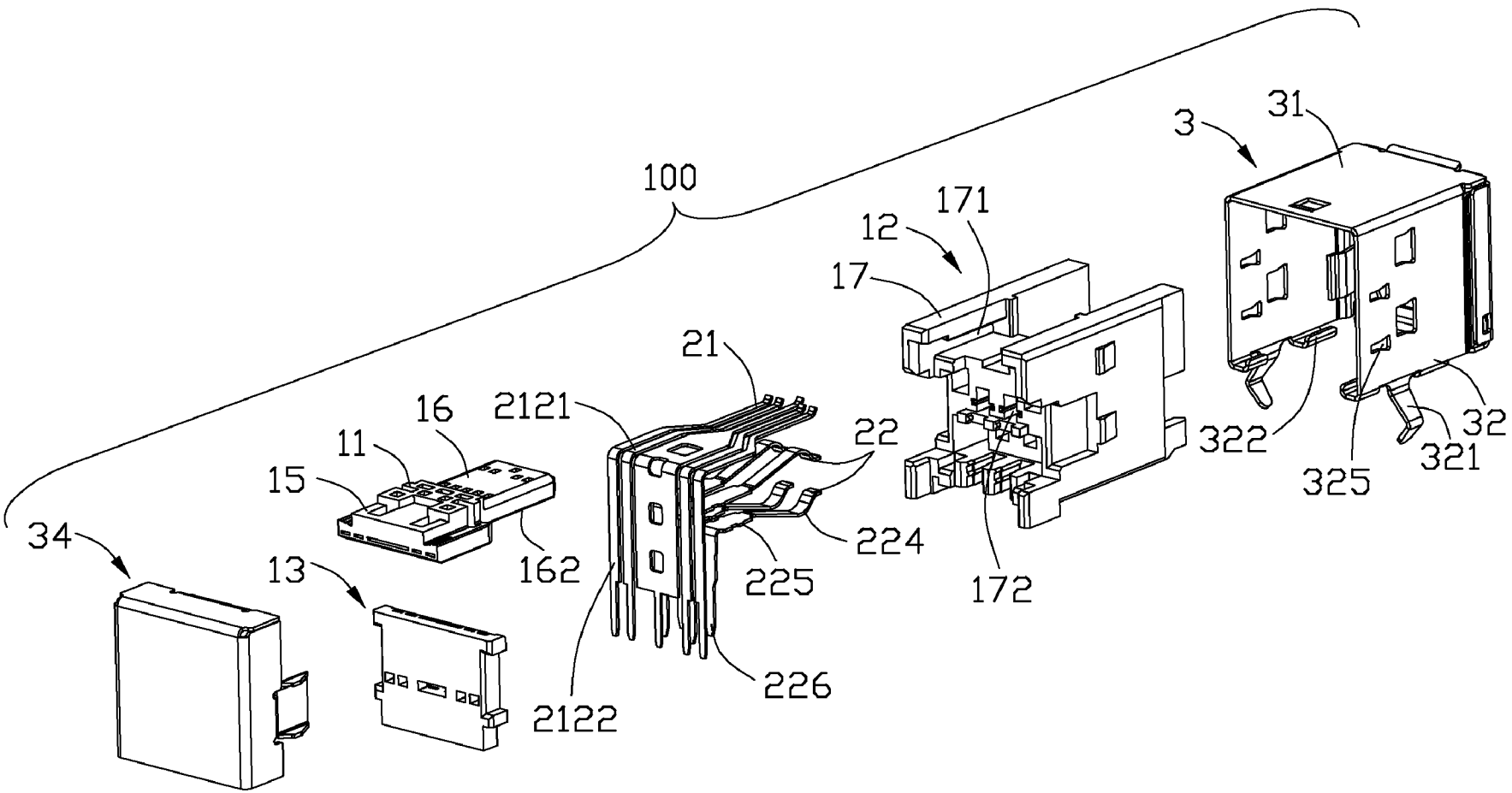
FIG. 4 is a view similar to FIG. 3, while taken from a different aspect.
Figure 5:
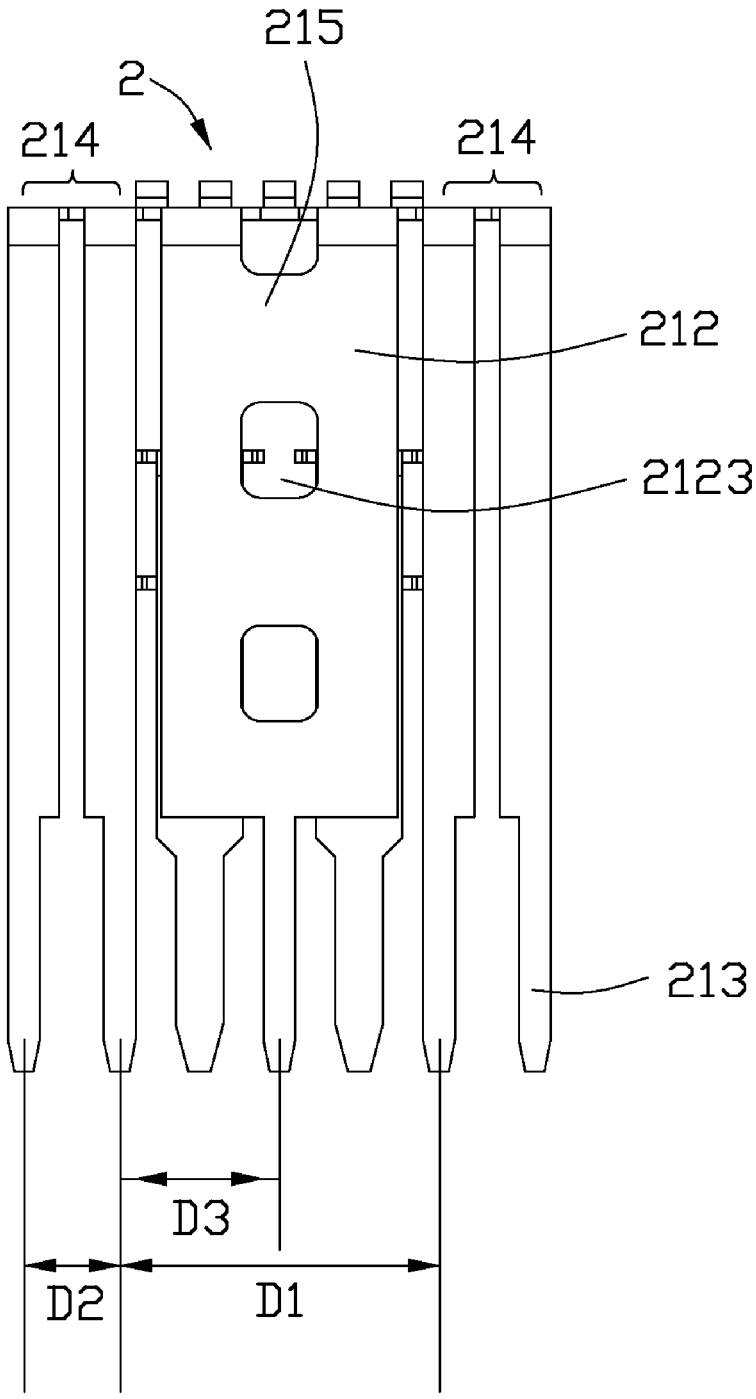
FIG. 5 is a rear elevational view of a plurality of contacts of the electrical connector.

Referring to FIGS. 1-5, an electrical connector 100 for soldering to a circuit board 200 according to the present invention is an USB 3.0 B type receptacle connector which can mate with a standard USB 3.0 B type plug (not shown) and a standard USB 2.0 B type plug (not shown). The electrical connector 100 comprises an insulative housing 1, a plurality of contacts 2 attached to the insulative housing 1 and a metal shell 3 covering the insulative housing 1.

The insulative housing 1 comprises a first housing 11, a second housing 12 and a spacer 13 assembled together. The second housing 12 defines a mating port 14 for receiving the USB 3.0 or USB 2.0 B type plug. The mating port 14 has a first receiving cavity 141 and a second receiving cavity 142 located below the first receiving cavity 141. The first receiving cavity 141 communicates with the second receiving cavity 142 in an up to down direction and is essentially narrower than the second receiving cavity 142. The first housing 11 has a first base portion 15 and a first tongue 16 integrally extending into the first receiving cavity 141. The first base portion 15 has a pair of ribs 151 extending outwardly from two sides thereof. The first tongue 16 has a mounting surface 162 at a lower side thereof.

The second housing 12 has a second base portion 17 and a second tongue 18 extending into the second receiving cavity 142. The second tongue 18 is parallel to the first tongue 16 and thicker than the first tongue 18 in a vertical direction of the insulative housing 1. The second base portion 17 defines a pair of grooves 171 extending forwardly from a rear and upper end thereof to engage with the ribs 151 for positioning the first housing 11 to the second housing 12. The second base portion 17 further defines two pairs of passageways 172 extending therethrough in an insertion direction of the plug and a pair of cutouts 173 recessed from two sides thereof to retain the metal shell 3. The second tongue 18 has a pair of opposite first and second surface 181, 182 each of which defines a pair of slots 183 communicating with the passageways 171 respectively, and the first and second surface 181, 182 are upper and lower surfaces of the second tongue 18.

The contacts 2 comprise a plurality of first contacts 21 insert molded in the first housing 11 and a plurality of second contacts 22 assembled in the second housing 12. Each first contact 21 has a first contact portion 211 disposed on a mounting surface 162 of the first tongue 16, a first tail portion 213 extending out of the insulative housing 1 and a first connecting portion 212 connecting the first contact portion 211 and the first tail portion 213. The first connecting portion 212 presents as L shaped and has a level portion 2121 extending in the insertion direction and a vertical portion 2122 extending in a vertical direction perpendicular to the insertion direction and the transverse direction from a rear end of the level portion 2121. The first contact portions 211 extend forwardly from a front end of the level portion 2121 and are exposed to the first receiving cavity 141, and all first contact portions 211 of the first contacts 21 have same width and same distance therebetween. The first tail portion 213 extends downwardly from a lower end of the vertical portion 2122 in the vertical direction.

The first contacts 21 are arranged in a row in a transverse direction of the insulative housing 1 and comprise two pairs of first differential signal contacts 214 and a first grounding contact 215 between said two pairs of the first differential signal contacts 214. The first connecting portions 212 of the two pairs of the first differential signal contacts 214 extend sidewardly and backwardly from a rear end of the first contact portions 211 in a transverse direction to enlarge the space therebetween for decreasing crosstalk. Thereby the first tail portions 213 define a first distance D1 between said two pairs of first differential signal contacts 214 and a second distance D2 in each pair of first differential signal contacts 214. The first distance D1 twice larger than the second distances D2 to assure said two pairs of first differential signal contacts 214 would not have crosstalk therebetween.

The first connecting portion 212 of the first grounding contact 215 is wider than that of each first differential signal contacts 214 in the transverse direction to absorb more disturb between the first differential signal contacts 214, and adjust impedance between said two pairs of the first differential signal contact 214 for assuring the electrical connector 100 have stable signal transmission. The wider first connecting portion 212 of the first grounding contact 215 defines a plurality of hollows 2123 to prevent the first connecting portion 212 from rebounding in a bending process of the first connecting portion 212. The first tail portion 213 of the first grounding contact 215 is narrower than the first connecting portion 212 thereof in the transverse direction and extends downwardly from a lower middle end of the first connecting portion 212. Therefore, the tail portions 213 define a third distance D3 between the first differential signal contacts 214 and the first grounding contact 215. The third distance D3 is wider than the distance D2 in the transverse direction.

The first housing 11 is insert molded around all first contact portions 211 and level portions 2121 of the first connecting portions 212. The spacer 13 is insert molded around all vertical portions 2122 of first connecting portions 212. Therefore, the assemble process of the first contacts 21 can be omitted.

The second contacts 22 comprise a power contact 223, a pair of second differential signal contacts 221 and a second grounding contact 222. Each second contact 22 has a second retaining portion 225 retained in the passageways 172 of the second housing 12, a flexible second contact portion 224 extending forwardly from a front end of the second retaining portion 225 and a second tail portion 226 extending downwardly from a rear end of the second retaining portion 225. The first contact portions 224 are cantileveredly received in the slots 183 of the second tongue 18 and protrude into the second receiving cavity 142. The second tail portions 226 are arranged in two rows in the insertion direction and located at a front side of the first tail portions 213.

The second contact portions 224 of the power contact 223 and one of the pair of second differential signal contact 221 are disposed on the first surface 181, and the second contact portions 224 of the second grounding contact 222 and one of the second differential signal contacts 221 are disposed on the second surface 182. The second contact portions 224 of the pair of second differential signal contacts 221 are aligned with each other along the up to down direction. The second contact portions 224 of the power contacts 223 and the second grounding contact 222 are aligned with each other along the up to down direction. Therefore, an arrangement of the second contact portions 224 is same to that of the contacts of standard USB 2.0 B type receptacle and can mate with the USB 2.0 B type plug, and an arrangement of the first contact portions 211 disposed on the first tongue 16 and the second contact portions 224 disposed on the second tongue 18 is same to the arrangement of the contacts of the standard USB 3.0 receptacle and can mate with the USB 3.0 B type plug.

The metal shell 3 covers the insulative housing 1 to form said mating port 14 with the tongues 16, 18. The metal shell 3 has a top wall 31, a pair of side walls 32 bending downwardly from two sides of the top wall 31, a mating wall 33 partially covering a front side of the mating port 14 and a rear wall 34 covering a rear side of the insulative housing 1. Each side wall 33 has a mounting leg 321 extending downwardly from a lower end thereof to mount the electrical connector 100 to the circuit board 200, a pair of barbs 322 extending inwardly from a lower end thereof to lock with a lower side of the second housing 12, and a spring arm 323 bending backwardly from a front end thereof to engage with the corresponding plug. The mating wall 33 bends downwardly from a front end of the top wall 31 and has a pair of flanges to lock with two side walls 32. The mating wall 33 defines an opening 330 corresponding to the mating port 14. The rear wall 34 has a pair of latch strips 341 extending inwardly and forwardly from two sides thereof to be retained in the cutouts 173 of the second housing 12. Each side wall 32 defines a pair of slits 325 at a rear side thereof. The latch strips 341 each has a pair of projections 345 bending outwardly from upper and lower sides thereof to lock with the slits 325.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing defining a first receiving cavity with a first tongue extending thereinto and a second receiving cavity with a second tongue extending thereinto, the first receiving cavity communicating with the second receiving cavity in an up to down direction and being essentially narrower than the second receiving cavity, the first tongue being parallel to the second tongue;

a plurality of first contacts arranged in a row along a transverse direction of the insulative housing and being equipped with a first center grounding contact and two pairs of first differential signal contacts at two sides of said first center grounding contact, each first contact having a contact portion disposed on a mounting surface of the first tongue, a tail portion extending out of the insulative housing and a connecting portion between the contact portion and the tail portion; and a plurality of second contacts disposed on opposite first and second surfaces of the second tongue;

wherein the tail portions defines a first distance between said two pairs of first differential signal contacts and a second distance between each pair of first differential signal contacts in a transverse direction of the insulative housing, and the first distance is at least twice larger than the second distance; wherein the tail portions define a third distance between the first differential signal contacts and the first grounding contact, and the third distance is larger than the second distance.

2. The electrical connector as claimed in claim 1, wherein all contact portions of the first contacts have same width and same distance therebetween in the transverse direction, and the connecting portion of the first grounding contact is wider than that of each first differential signal contacts along the transverse direction.

3. The electrical connector as claimed in claim 2, wherein the connecting portion of the first grounding contact defines a plurality of hollows.

4. The electrical connector as claimed in claim 2, wherein the tail portion and contact portion of the first grounding contact are narrower than the connecting portion thereof along the transverse direction.

5. The electrical connector as claimed in claim 4, wherein all connecting portions of the first contacts present as L shaped and has a level portion extending in an insertion direction of the corresponding plug and a vertical portion extending downwardly in a vertical direction perpendicular to the insertion direction and the transverse direction, and the tail portion of the first grounding contact extends downwardly from a lower middle end of the connecting portion in the vertical direction.

6. The electrical connector as claimed in claim 2, wherein the connecting portions of the two pairs of differential signal contacts extend sidewardly from a rear end of the contact portions in a transverse direction to enlarge space therebetween for decreasing crosstalk therebetween.

7. The electrical connector as claimed in claim 1, wherein each second contact has a contact portion extending to the second tongue and a tail portion extending out of the insulative housing, an arrangement of the contact portions of the second contacts disposed on the second tongue is same to that of a standard USB 2.0 B type receptacle; and the second tongue is much thicker than the first tongue and located below the first tongue, and an arrangement of the contact portions of all first and second contacts disposed on the first and second tongue respectively is same to that of a standard USB 3.0 B type receptacle.

8. The electrical connector as claimed in claim 7, wherein the tail portions of the second contacts are arranged in two rows along an insertion direction of a corresponding plug and located at a front side of tail portions of the first contacts.

9. The electrical connector as claimed in claim 1, further comprising a metal shell covering the insulative housing, the insulative housing defines a pair of cutouts at two sides thereof, the metal shell has a top wall, a pair of side walls bent downwardly from two sides of the top wall and a rear wall engaging with the side walls, each side wall defines a slit at a rear side thereof, and the rear wall has a pair of latch strips extending inwardly and forwardly from two sides thereof to be retained in the cutout, and each latch strip has a projection bending outwardly from one side thereof to lock with the slit.

10. An electrical connector defining a receiving cavity for receiving a corresponding plug, comprising:

an insulative housing;

a plurality of contacts retained in the insulative housing, the contacts comprising a plurality of first contacts which are arranged in a row along a transverse direction of the insulative housing, the first contacts comprising two pairs of differential signal contacts and a grounding contact between said two pairs of differential signal contacts, each first contact having a contact portion extending into the receiving cavity, a tail portion extending out of the insulative housing and a connecting portion between the contact portion and the tail portion;

wherein the contact portions of said first contacts define a same pitch;

wherein the tail portions of each pair of differential signal contacts define a distance therebetween in the transverse direction, the tail portions of the grounding contact and an adjacent differential signal contact define another distance therebetween, and the another distance is larger than the distance.

11. The electrical connector as claimed in claim 10, wherein the connecting portion of the grounding contact is wider than that of the differential signal contacts in the transverse direction.

12. The electrical connector as claimed in claim 10, wherein the connecting portions of the two pairs of differential signal contacts extend sidewardly from a rear end of the contact portions in a transverse direction to form a large space therebetween for decreasing crosstalk therebetween.

13. The electrical connector as claimed in claim 12, wherein all contact portions of the first contacts have same width and same distance therebetween, and the tail portion and contact portion of the grounding contact are narrower than the connecting portion thereof in the transverse direction.

14. The electrical connector as claimed in claim 10, wherein all connecting portions of the first contacts present as L shaped, and has a level portion extending in an insertion direction of the corresponding plug and a vertical portion extending downwardly in a vertical direction perpendicular to the insertion direction and the transverse direction, and the tail portion of the first grounding contact extends downwardly from a lower middle end of the connecting portion in the vertical direction.

15. An electrical connector comprising:

an insulative housing defining a mating port with upper and lower horizontally extending mating tongues therein;

a plurality of lower contacts disposed in the housing, each of said lower contacts defining a lower contacting section horizontally exposed upon the lower mating tongue and a lower mounting section downwardly extending behind the lower mating tongue; and a plurality of upper contacts disposed in the housing, each of said upper contacts defining an upper contacting section horizontally exposed upon the upper mating tongue and an upper mounting section downwardly extending behind the upper mating tongue and behind the mounting sections of the lower contacts; wherein the upper contacts includes one grounding contact and two differential pairs by two sides of the grounding contact, and the lower contacts includes two contacts under condition that relative to the corresponding upper contacting sections, the upper mounting sections of said two differential pairs are deflected transversely away from each other so as to enlarge a pitch with regard to the grounding contact in comparison with that among the upper contacting sections of said upper contacts wherein in a front-to-back view, the lower mounting sections of the two lower contacts respectively located between the grounding contact and the corresponding differential pair;

the lower mounting section of one of the lower contact and the upper mounting section of the grounding contact of the upper contact and the upper mounting section of an inner one of the corresponding different pair of the upper contact adjacent said one of the lower contacts constitute an isosceles triangle wherein two inner upper mounting portions of each pair of differential signal contacts define a distance therebetween in the transverse direction, the upper mounting portions of the grounding contact and an adjacent differential signal contact define another distance therebetween, and the another distance is wider than the distance.

16. The electrical connector as claimed in claim 15, wherein the lower mounting sections of the lower contacts and the upper mounting section of the grounding contact of the upper contact constitutes an isosceles triangle.

17. The electrical connector as claimed in claim 15, wherein in said front-to-back view, a pitch among the upper mounting section and the lower mounting sections of the intermixed upper contacts and lower contacts is essentially roughly consistent along a transverse direction perpendicular to a front-to-back direction.

18. The electrical connector as claimed in claim 15, wherein each of said upper contacts defines an upper connecting portion horizontally coplanar with the corresponding contacting section and linked between the corresponding contacting section and upper mounting section, the upper connecting portions of said two pairs of differential pairs are deflected transversely away from each other to comply with the corresponding upper mounting sections.

19. The electrical connector as claimed in claim 18, wherein the grounding contact is dimensioned to be transversely enlarged in both the upper connecting section and the upper mounting section to comply with the transversely deflected upper connecting sections and upper mounting sections of the two pairs of the differential pairs by two sides of the grounding contact.

* * * * *